United States Patent [19]

Hardin et al.

[11] 4,160,814

[45] Jul. 10, 1979

[54] THERMAL DESULFURIZATION AND CALCINATION OF PETROLEUM COKE

[75] Inventors: Edward E. Hardin; Dean H. Guffey; Lloyd I. Grindstaff, all of Elizabethton, Tenn.

[73] Assignee: Great Lakes Carbon Corporation, New York, N.Y.

[21] Appl. No.: 882,336

[22] Filed: Mar. 1, 1978

[51] Int. Cl.[2] ..... C01B 31/02; C01B 31/04; C10B 57/02

[52] U.S. Cl. ..... 423/461; 201/17; 201/44; 423/448

[58] Field of Search ..... 201/17, 44; 423/445, 423/448, 461; 44/1 R; 264/29.5

[56] References Cited

U.S. PATENT DOCUMENTS

| | | | |
|---|---|---|---|
| 2,717,868 | 9/1955 | Gorin et al. | 201/17 |
| 2,726,148 | 12/1955 | McKinley et al. | 201/17 X |
| 2,764,530 | 9/1956 | Klemgard | 201/44 X |
| 3,130,133 | 4/1964 | Levenstein | 201/17 X |
| 3,272,721 | 9/1966 | Levenstein | 201/17 X |
| 3,759,673 | 9/1973 | Whitten et al. | 201/17 X |
| 4,100,265 | 7/1978 | Yoshimura et al. | 423/449 |

FOREIGN PATENT DOCUMENTS

| | | | |
|---|---|---|---|
| 684454 | 4/1964 | Canada | 201/17 |
| 29801/77 | 3/1977 | Japan. | |
| 755061 | 8/1956 | United Kingdom. | |

*Primary Examiner*—Joseph Scovronek
*Attorney, Agent, or Firm*—R. Laddie Taylor

[57] ABSTRACT

Low sulfur calcined coke is produced from high sulfur raw coke without substantially lowering its bulk density by heating the coke at a first temperature such that no more than about 70 wt.% of the volatile matter is removed therefrom and then heating the partially devolatilized coke at a higher temperature sufficient to effect calcination and desulfurization.

2 Claims, No Drawings

THERMAL DESULFURIZATION AND CALCINATION OF PETROLEUM COKE

BACKGROUND OF THE INVENTION

1. Field of the Invention

This invention relates generally to a process for improving the properties of raw or "green" cokes obtained by known processes from materials of petroleum origin and particularly to a process for desulfurizing and calcining such cokes without substantially lowering their bulk densities. As used herein, the phrase "without substantially lowering the bulk density" refers to the value of the bulk density of the final product of the process of the invention (desulfurized calcined coke) in relation to the bulk density of the same feed material (raw petroleum coke) after conventional calcination.

The major source of industrial petroleum coke originates in the delayed coker, and is produced at temperatures of about 900° F. (482° C.) by methods well known in the art. Unfortunately, many petroleum cokes produced by this method and other known methods contain appreciable amounts of sulfur, and cannot be directly utilized in the fabrication of carbon products due to this impurity. Aluminum producers, for example, the largest consumer in total quantity of calcined petroleum coke, demand low sulfur coke to satisfy pollution control requirements. It is therefore imperative that an economical process be available to bring about a substantial reduction in the sulfur content of these cokes, desirably to a level below 2 wt.%, and preferably to a level below 1.5 wt.%.

Raw petroleum coke for industrial purposes is conventionally calcined at temperatures in the range of about 1150°-1300° C. by methods well known in the art to remove a major portion of the volatile matter content of the coke and to provide increased density and conductivity therefor. During substantially complete calcination, the volatile matter content of petroleum coke is commonly reduced to below 1 wt.% and preferably below 0.5 wt.%. It is known that the customary temperatures utilized for calcination are not sufficiently high to bring about desulfurization of the coke.

A physical property of calcined petroleum coke recognized in the art as useful for determining the quality of the coke is bulk density, which is the weight per unit volume of coke particles having a defined size range. This value is commonly expressed in pounds/cubic foot or grams/100 cc. It is known that the bulk density of calcined coke must be maintained as high as possible to provide desirable properties, such as high strength, for products made from the coke. For example, the strength, reactivity and consumption rate of carbon anodes used in the electrolytic production of aluminum are directly related to the bulk density of the calcined petroleum coke used in the fabrication of such anodes. A reduction of more than about 10 percent of the bulk density of conventionally calcined coke will substantially affect the properties of a carbon product containing such coke.

2. Description of the Prior Art

It is known to desulfurize raw petroleum coke by directly heating the coke in a single stage to a temperature above about 1500° C. in a rotary kiln or the like. Experience has taught that while this procedure effectively reduces the sulfur content of the coke, the bulk density and other physical properties are substantially deteriorated during the desulfurization process, as compared to the coke properties after calcination at conventional temperatures.

In the past, many staged processes have been developed for desulfurizing petroleum coke, particularly high sulfur fluid coke.

One method known in the art for the step-wise desulfurization of petroleum coke includes at least one stage wherein the coke is treated with hydrogen gas at elevated temperature. U.S. Pat. Nos. 2,721,169; 2,812,289 and 3,007,849 generally disclose such method for desulfurizing fluid coke. This method of treatment is expensive due to the relatively long treating time required and the cost of the hydrogen. Additionally, it is known that a hydrogen treatment of petroleum coke at elevated temperatures has a detrimental effect on various physical properties of coke, particularly the bulk density, compared to coke properties after conventional calcination.

Another step-wise method for desulfurizing petroleum coke generally comprises heating the coke at temperatures such that essentially all the volatile matter is removed therefrom and then heating the fully devolatilized coke at temperatures such that essentially all of the sulfur is expelled therefrom separately from the volatile components. U.S. Pat. Nos. 2,743,218 and 2,819,204, and British Pat. No. 755,061 generally disclose such a sulfur removal process. However, it has been discovered that removal of all the volatile matter of petroleum coke at an elevated temperature before further heating the coke to a temperature sufficient to desulfurize the coke produces a substantial reduction in the bulk density of the coke, compared to the bulk density of the coke after conventional calcination. Additionally, an appreciably lower amount of external fuel is required to heat the volatile-containing coke from the first stage of the process of the instant invention to desulfurizing temperatures as compared to fully devolatilized petroleum coke.

U.S. Pat. No. 2,716,628 provides a process for desulfurizing petroleum coke wherein the coke is held in a heat-soaking zone for a period of about six to twenty hours at a temperature of 2500° to 3000° F. (1371° to 1649° C.), and then contacted with a fuel gas, preferably methane, in a cooling zone, the coke in the heat-soaking zone being contacted with gas from the cooling zone in the presence of oxygen, the oxidation of the coke being minimized by the preferential combustion of the fuel gas from the cooling zone. An excess of fuel gas beyond that required for combustion is utilized to provide a heat transfer medium between the zones. This process is prohibitively expensive due to the requirement of excess fuel gas, the necessity of a source for the oxygen-containing gas and the time required for the heat-soaking treatment. It is known that treating petroleum coke with an oxygen-containing gas at elevated temperature has a detrimental effect on its bulk density due to excessive burning of the carbon material, which burning causes a comparatively rapid devolatilization of the coke, thus increasing the porosity.

U.S. Pat. No. 3,369,871 provides a multi-stage process for fabricating a low sulfur metallurgical carbon product from green petroleum coke comprising heating the coke at a temperature of at least 300° F. (149° C.) while flowing an oxygen-containing gas thereover to reduce the sulfur content of the coke, heating the desulfurized coke at a temperature of at least 1600° C. and preferably about 1800°-3500° C. or more, to partially graphitize the coke, cooling the partially graphitized coke to about 1000° F. (538° C.), and subjecting the cooled coke to oxidizing gases until its sulfur content is below 0.2%. The bulk density of the coke resulting from this process would be detrimentally affected by the oxygen-containing gas treatment for the reasons presented above. Additionally, the temperatures required for the partial graphitization stage usually entail the use of expensive specialized heating techniques (e.g., induction heating) and equipment.

SUMMARY OF THE INVENTION

The present invention provides a process for calcining and thermally desulfurizing raw petroleum coke having a high sulfur content without substantially lowering the bulk density comprising: (a) heating the coke at a first temperature above that at which the coke was formed, for a period of time such that no more than about 70 wt.% of the volatile matter content of the coke is removed; and (b) heating the partially devolatilized coke at a second temperature higher than that used in step (a) for a period of time sufficient to substantially completely calcine the coke and remove a major portion of the sulfur content therefrom.

It is pointed out that the temperature in step (b) of the process of the present invention is inherently higher than conventional coke calcination temperatures, by reason of the fact that normal calcination temperatures are not adequate to induce desulfurization.

The thermal treatment steps can be accomplished by any known heating apparatus, such as, for example, rotary kilns or multiple hearth furnaces, and is practical and economical for industrial operations presently equipped for calcining petroleum coke. The steps may be effected by heating the coke to a first temperature as defined in step (a) above followed by further heating to the temperatures defined in step (b), or the coke may be allowed to cool between the heating steps.

Generally, the initial thermal treatment of the coke is carried out at a temperature in the range of about 490° to 850° C. for a period of about 30 to 60 minutes. It is critical that at least about 30 wt.% of the volatile matter of the coke is retained therein after this treatment step. It has been discovered that if more than about 70 wt.% of the volatile matter is removed from the coke during this first thermal treatment step disclosed herein, a degradation of the structure of the coke occurs, bringing about a substantial reduction of the bulk density of the resulting desulfurized coke, compared to the bulk density of the coke after conventional calcination. Additionally, the volatile matter retained in the coke is available for utilization as part of the fuel for the final thermal treatment step, which treatment is preferably carried out at a temperature of at least about 1500° C., and ideally at a temperature in the range of 1500° to 1650° C., for a period of about 30 to 70 minutes.

The optimum temperatures and treatment periods for the heating steps vary with specific cokes.

DESCRIPTION OF THE PREFERRED EMBODIMENTS

The preferred embodiments of the novel process of the invention will now be described in the following non-limiting examples. The temperatures and heating periods for the two stage desulfurization/calcination treatment in each case were selected such that the original volatile content of the coke after the first stage treatment was not reduced more than about 70 wt.%. Unless otherwise specified, all bulk density values were determined using a coke sample having a particle size between 3.36 and 4.76 mm (−4/+6 mesh Tyler Screen Scale). All cokes employed in the examples were "regular" raw petroleum cokes, also known in the art as "sponge" type cokes, produced from reduced crude feedstocks by the conventional delayed coking process at a temperature of about 900° F. (482° C.).

EXAMPLE 1

A raw petroleum coke having a sulfur content of 4.68 wt.% was reduced to a particle size below 5.66 mm (−3½ mesh Tyler Screen Scale) and thermally treated in two stages as follows. The coke particles were introduced into a furnace having a nitrogen atmosphere preheated to 800° C. After the coke was exposed to this thermal treatment for 60 minutes, it was removed from the furnace and allowed to cool in a nitrogen atmosphere to prevent oxidation thereof. The coke was then introduced into a furnace having a nitrogen atmosphere preheated to 1500° C. and allowed to remain at this temperature for 45 minutes. The fully calcined product had a sulfur content of 1.33 wt.% and a bulk density of 58 g/100 cc. The same coke had an identical bulk density after treatment at conventional calcining temperatures. A single stage desulfurization treatment of this coke at 1500° C., for a time period equal to the period employed for desulfurization in this example according to the invention, produced a bulk density of only 48 g/100 cc.

EXAMPLE 2

A sample of the raw coke employed in Example 1 was treated at the same temperatures for the same time periods as in the first example with the exception that the coke was not allowed to cool between the treatment stages. The fully calcined product had a bulk density of 58 g/100 cc and a sulfur content of 1.43 wt.%.

EXAMPLE 3

A raw petroleum coke sample having a sulfur content of 4.18 wt.% was treated as in Example 1 with the exception that the two thermal treatment temperatures were 500° C. and 1600° C. respectively, with treatment periods of 45 minutes for each stage. The fully calcined product had a bulk density of 61 g/100 cc and a sulfur content of 0.47 wt.%. The coke had a bulk density of 64 g/100 cc after conventional calcination and a bulk density of only 53 g/100 cc after a one-stage desulfurization treatment at 1600° C. for a time period equal to the period employed for desulfurization in this example according to the invention.

EXAMPLE 4

A sample of the raw coke employed in Example 3 was treated as in that example except that the first thermal treatment temperature was 700° C. The fully calcined product had a bulk density of 60 g/100 cc and a sulfur content of 0.40 wt.%.

EXAMPLE 5

A raw petroleum coke sample having a sulfur content of 3.85 wt.% was treated as in Example 1 with the exception that the two thermal treatment temperatures were at 600° C. and 1600° C. respectively, with treatment periods of 45 minutes for each stage. The fully calcined product had a bulk density of 54 g/100 cc and a sulfur content of 0.39 wt.%. The coke had a bulk density of 56 g/100 cc after conventional calcination and a bulk density of only 46 g/100 cc after a single stage desulfurizing treatment at 1600° C. for a time period equal to the period employed for desulfurization in this example according to the invention.

EXAMPLE 6

A sample of the raw coke employed in Example 5 was treated as in that example except that the first thermal treatment temperature was 700° C. The fully calcined product had a bulk density of 56 g/100 cc and a sulfur content of 0.36 wt.%.

EXAMPLE 7

Raw petroleum coke having a sulfur content of 4.83 wt.% and an average volatile matter content of 12.0 wt.% was fed to a conventional rotary calcining kiln adjusted to provide a maximum coke temperature of approximately 500° C. and a residence time of about 45 minutes. The coke collected from this procedure, which had an average volatile matter content of 7.4 wt.%, was fed to a rotary calcining kiln adjusted to provide a maximum coke temperature of approximately 1520° C. and a residence time of about 60 minutes. The final fully calcined product had a sulfur content of 1.38 wt.% and a bulk density of 45 lb./ft.$^3$ (Run of Kiln particles). The same coke had a bulk density of 47 lb./ft.$^3$ after conventional calcination and a bulk density of only 41 lb./ft.$^3$ after a single stage desulfurization treatment at 1550° C.

While the invention has been described in detail and with reference to specific embodiments thereof, it will be apparent to one skilled in the art that various changes and modifications can be made therein without departing from the scope and spirit thereof, and, therefore, the invention is not intended to be limited except as indicated in the appended claims.

We claim:

1. A process for calcining and thermally desulfurizing raw petroleum coke without substantially lowering the bulk density of said coke, said coke having a high sulfur content and having been produced by the delayed coking process, which comprises:

(a) heating the coke at a first temperature in the range of about 490° to about 850° C. for a period of time in the range of about 30 to about 60 minutes such that no more than about 70 wt.% of the volatile matter content of said coke is removed therefrom; and (b) heating the partially devolatilized coke at a second temperature of at least about 1500° C. for a period of time in the range of about 30 to about 70 minutes to substantially completely calcine said coke and remove a major portion of the sulfur content therefrom.

2. A process for calcining and thermally desulfurizing raw petroleum coke without substantially lowering the bulk density of said coke, said coke having a high sulfur content and having been produced by the delayed coking process, which comprises:

(a) heating the coke at a temperature of about 500° C. for about 45 minutes such that no more than about 70 wt.% of the volatile matter content of said coke is removed therefrom; and (b) heating the partially devolatilized coke at a temperature of about 1520° C. for 60 minutes to substantially completely calcine said coke and remove a major portion of the sulfur content therefrom.

* * * * *